US009797359B2

(12) United States Patent
Kullberg et al.

(10) Patent No.: US 9,797,359 B2
(45) Date of Patent: Oct. 24, 2017

(54) STARTING DEVICE FOR AN INTERNAL COMBUSTION ENGINE

(71) Applicant: HUSQVARNA AB, Huskvarna (SE)

(72) Inventors: Stefan Kullberg, Jönköping (SE); Joakim Persson, Skillingaryd (SE); Anders Hansson, Huskvarna (SE); Håkan Fransson, Jönköping (SE)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 15/037,439

(22) PCT Filed: Nov. 18, 2013

(86) PCT No.: PCT/SE2013/051350
§ 371 (c)(1),
(2) Date: May 18, 2016

(87) PCT Pub. No.: WO2015/072900
PCT Pub. Date: May 21, 2015

(65) Prior Publication Data

US 2016/0290303 A1 Oct. 6, 2016

(51) Int. Cl.
*F02N 3/02* (2006.01)
*F02N 5/02* (2006.01)
*F02N 15/02* (2006.01)

(52) U.S. Cl.
CPC ..... *F02N 3/02* (2013.01); *F02N 5/02* (2013.01); *F02N 15/027* (2013.01)

(58) Field of Classification Search
CPC ..... F02N 5/02; F02N 3/02; F02N 15/006
(Continued)

(56) References Cited

U.S. PATENT DOCUMENTS 1,622,289 A 3/1927 Nelson
3,465,740 A * 9/1969 Harkness ..... F02N 3/02 123/185.1

(Continued)

FOREIGN PATENT DOCUMENTS

EP 1712779 A2 10/2006
JP S5523465 U 2/1980

(Continued)

OTHER PUBLICATIONS

International Search Report & Written Opinion of International Patent Application No. PCT/SE2013/051350 mailed Oct. 7, 2014, all enclosed pages cited.

(Continued)

*Primary Examiner* — Hai Huynh
*Assistant Examiner* — Long T Tran
(74) *Attorney, Agent, or Firm* — McNair Law Firm, P.A.

(57) ABSTRACT

The invention relates to a starting device (10) for an internal combustion engine, the starting device (10) comprising a hub (12; 70) configured to drivingly engage an internal combustion engine when the hub (12; 70) is rotated in a first direction (A); a pulley (14; 47; 60) interconnected with the hub (12; 70) by a spring (23; 41); a shaft (21) on which the pulley (14; 47; 60) and hub (12; 70) are mounted independently rotatable; a flexible member (16) attached to and coiled about the pulley (14; 47; 60); and where the spring (23; 41) coupled at a first end (26; 53) to the hub (12; 70) and at a second end (28; 54) to the pulley (14; 47; 60). The pulley (14; 47; 60) comprises a recess (15) arranged to receive the flexible member (16), which recess has the shape of a conical helix having a first end (15A) with a first diameter and a second end (15B) with a second diameter, larger than the first diameter; and is attached to the pulley (14; 47; 60) at the second end (15B).

23 Claims, 7 Drawing Sheets

(58) Field of Classification Search
USPC ..... 123/185.3, 185.14
See application file for complete search history.

(56) References Cited

U.S. PATENT DOCUMENTS

| | | | | |
|---|---|---|---|---|
| 3,858,566 | A | 1/1975 | Perry | |
| 3,942,505 | A * | 3/1976 | Tillotson | A01D 34/6818 123/185.3 |
| 5,287,832 | A | 2/1994 | Uhl | |
| 6,263,852 | B1 * | 7/2001 | Gracyalny | F02N 5/02 123/185.14 |
| 6,386,169 | B1 * | 5/2002 | Gracyalny | F02N 5/02 123/185.14 |
| 8,132,553 | B2 * | 3/2012 | Eakins, Jr. | F02N 3/02 123/185.14 |
| 8,291,879 | B2 * | 10/2012 | Eakins, Jr. | F02N 3/02 123/185.14 |
| 2003/0213455 | A1 | 11/2003 | Tohyama | |
| 2005/0211216 | A1 * | 9/2005 | Otsuki | F02B 75/34 123/185.3 |
| 2010/0170465 | A1 * | 7/2010 | Eakins, Jr. | F02N 3/02 123/185.3 |
| 2012/0132170 | A1 | 5/2012 | Wenckel et al. | |

FOREIGN PATENT DOCUMENTS

| | | | |
|---|---|---|---|
| JP | S5576462 | U | 5/1980 |
| JP | 2003336567 | A | 11/2003 |
| KR | 20090101618 | A | 9/2009 |
| WO | 2012008980 | A1 | 10/2012 |
| WO | 2013137783 | A1 | 9/2013 |

OTHER PUBLICATIONS

Chapter I International Preliminary Report on Patentability of International Patent Application No. PCT/SE2013/051350 issued on May 24, 2016.

* cited by examiner

*FIG.* 2

STARTING DEVICE FOR AN INTERNAL COMBUSTION ENGINE

TECHNICAL FIELD

The present invention relates to a starting device for an internal combustion engine. Specifically, the present disclosure presents an arrangement for providing rotation of a hub by rotating a pulley, wherein the pulley and hub being interconnected by a spring.

BACKGROUND ART

Internal combustion engines are often provided with a manual starting mechanism. For example, a chainsaw includes a rope starting mechanism for starting the internal combustion engine. The rope starter uses a pulling force from the operator to rotate a pulley which in turn is coupled, through one or more components, to the crankshaft of the engine. The starter can include a rope pulley and hub for coupling with a clutch mechanism of the internal combustion engine.

A problem with starting an engine of this type is that the operator can experience varying degrees of resistance from the starting mechanism and the engine as the rope is pulled. Some operators can also find it difficult to exert sufficient pulling force to the rope pulley in order to crank the engine.

Hence, there is a need for an arrangement that at least partially mitigates the above problems. The object of the invention is to provide an improved starting mechanism that will allow the degree of resistance from the starting mechanism to be controlled and to facilitate starting.

DISCLOSURE OF INVENTION

The above problems are solved by an arrangement as described in the attached claims.

In the subsequent text, the term "conical helix" denotes a helical curve extending circumferentially around the surface of a conical body. The term "cone angle" is defined as the angle between the central axis of the conical body and an extrapolated line intersecting two subsequent points along the helical curve in a plane through the central axis. The points are separated by one turn of the helical curve around the conical body.

The invention relates to a starting device for an internal combustion engine. The starting device comprises a hub configured to drivingly engage an internal combustion engine when the hub is rotated in a first direction. A pulley is interconnected with the hub by a spring, such as a torsion spring, which spring can be integrated with the pulley or be mounted in a separate housing or holder mounted on or in the pulley. The pulley and hub are mounted independently rotatable on a common shaft that supports the starting device. A flexible member, such as a rope or a cord, is attached to and coiled about the pulley. The spring is coupled at a first end to the hub and at a second end to the pulley. The pulley is rotated in the first direction when the flexible member is pulled and unwound. The spring is arranged to act on the hub when energized, to rotate it and drivingly engage the internal combustion engine during start.

One or more contact surfaces or teeth on one end of the hub can be arranged to cooperate with one or more releasable locking mechanisms or pawls on an intermediate mechanism between the starter device and the internal combustion engine. When the hub is rotated in a first direction at least one tooth is arranged to cooperate with a corresponding pawl to drive the intermediate mechanism and crank the internal combustion engine. When the hub is rotated in a second direction or when the internal combustion engine is running the pawl disengages the one or more teeth of the hub, which is stationary during operation of the internal combustion engine. Mechanisms of this type are well known in the art, for example in WO2012/008980, and will not be described in further detail here.

According to the invention, the pulley comprises a helical recess arranged to receive the flexible member, wherein the helical recess is substantially shaped as a conical helix having a first end with a first radius and a second end with a second radius, larger than the first radius. The flexible member is attached to the pulley at the second end, where the helical recess in the pulley has its largest radius. The radii are measured from the central axis of the pulley to the bottom of the recess. A pulley comprising a helical recess according to the invention contributes to a more uniform, and in some cases a reduced, pulling force for a user during a cranking operation.

According to a first alternative example, the pulley can comprise an annular recess for receiving therein at least a part of the spring. The recess is preferably, but not necessarily, arranged in an axial end surface of the pulley adjacent the second end of the helical recess. The second end of the spring is attached to the outer periphery of the annular recess.

The pulley comprises an annular portion located in the recess and extending towards the hub. This annular, or tubular, portion can extend from the inner end surface of the annular recess along the shaft. The hub comprises an annular portion extending towards the pulley, wherein the first end of the spring is attached to this annular portion.

The annular portion of the hub extends into the annular recess in the pulley, at least partially enclosing the annular portion of the pulley. In this way the annular portion of the hub is arranged coaxially with and rotatable relative to the annular portion of the pulley. At least a part of the spring is located in an at least partially enclosed, annular space or cavity, formed by the annular recess in the pulley and the annular portion of the hub.

The conical helix forming the helical recess can be given a suitable shape in order to minimize fluctuations in pulling force when starting the engine and to allow a uniform and effortless pull during start. When a pulling force is first applied to the flexible member, the spring is coiled, i.e. energized, and the flexible member is unwound from the recess from its smallest to its largest radius. The initial force required to begin coiling the spring is relatively small. The relatively low torque applied to the pulley by the flexible member located at the smallest radius of the recess will therefore be sufficient for the initial coiling of the spring. As the flexible member is pulled further the radius at which it acts on the pulley will increase, providing an increasing torque to compensate for the gradually increasing resistance from the spring as it is coiled tighter. When the flexible member has been fully withdrawn, the spring is relaxed and the flexible member is rewound onto the pulley around the helical recess from its largest to its smallest radius.

According to the first alternative example described above, the annular portion of the hub extends into the annular recess in the pulley, at least partially enclosing the annular portion of the pulley. In this way, at least a part of the spring is located in an at least partially enclosed, annular space or cavity, formed by the annular recess in the pulley and the annular portion of the hub.

According to a second alternative example, at least a part of the spring can be located in a separate housing, or holder, comprising an outer cylindrical wall and a central annular portion connected by a radial end wall. This annular, or tubular, portion extends from the inner end surface of the radial end wall along an above-mentioned shaft that supports the starting device.

The separate housing forms an annular space or cavity that at least partially encloses the spring. The separate housing is in turn located in a substantially cylindrical recess in the pulley. The cylindrical recess is preferably, but not necessarily, arranged in an axial end surface of the pulley adjacent the second end of the helical recess. The housing and the pulley comprises means for preventing relative rotation between these components. One such means can be at least one cooperating projection and recess extending radially and/or axially relative to the cylindrical recess in the pulley. An alternative or complimentary means can be an axial projection having at least three sides and extending into a corresponding axial recess. The axial projection can be located either at the end of the separate housing or in the cylindrical recess in the pulley The spring is coupled at its first end, e.g. radially inner end, to the hub configured to drivingly engage an internal combustion engine, as described above. The hub comprises an annular portion extending towards the pulley, wherein the first end of the spring is attached to this annular portion. According to a preferred example, the annular portion of the separate housing extends towards and into the annular portion of the hub.

The second end, e.g. radially outer end, of the spring is coupled to the outer cylindrical wall of the housing. A radial projection extending from the separate housing into a corresponding radial recess in the pulley can also be adapted to form an attachment for the radially outer end of the spring.

Depending on the desired characteristics of the pulling force and/or the internal combustion engine to be started, the pulley and its recess can be adapted accordingly. Hence, the cone angle can be selected constant, or be gradually decreased or increased in one or more steps. The conical helix forming the recess can have a cone angle that alters, either decreases or increases, with each revolution from the first end towards the second end of the recess. Such arrangements will both reduce the size of the pulling force and minimize fluctuations in pulling force when starting the engine.

According to a first example, the conical helix forming the recess has a constant cone angle. As the flexible member is pulled the radius at which it acts on the pulley will increase at a constant rate, providing a constantly increasing torque to compensate for the gradually increasing resistance from the spring as it is loaded by being coiled tighter.

According to a second example, the conical helix forming the recess has at least two cone angles. In this example, a first cone angle, adjacent the first end is greater than a second cone angle adjacent the second end. Hence, the conical helix forming the recess has is its largest cone angle adjacent the first end. Instead of being reduced in steps, the conical helix forming the recess can have cone angle that decreases from a first angle to a second angle with each revolution towards the second end. As the flexible member is pulled the radius at which it acts on the pulley will increase at a decreasing rate, while still providing an increasing torque to compensate for the gradually increasing resistance from the spring as it is coiled tighter.

According to a third example, the conical helix forming the recess has at least two cone angles. In this example, a first cone angle, adjacent the first end is less than a second cone angle adjacent the second end. Hence, the conical helix forming the recess has is its smallest cone angle adjacent the first end. Instead of being induced in steps, the conical helix forming the recess can have a cone angle that increases from a first angle to a second angle with each revolution towards the second end. As the flexible member is pulled the radius at which it acts on the pulley will increase at an increasing rate, providing a progressively increasing torque to compensate for the gradually increasing resistance from the spring as it is coiled tighter.

The shape of the recess can be selected depending on the type of engine to be cranked and/or which characteristics can be expected to effect cranking. For instance, the hub can begin to rotate a portion of the internal combustion engine to initiate a cranking operation prior to the point where the flexible member reaches the end of the recess. In this case, the torque requirement towards the end of the pulling action will be reduced, as the spring has already started to uncoil. Hence, a recess with a constant or gradually reduced cone angle adjacent the second end of the recess can be used.

However, if a greater torque is required to crank the engine, then the torque requirement towards the end of the pulling action may continue to increase. Should the spring be required to be coiled to a maximum or near maximum degree, then a recess with a constant or progressively increasing cone angle adjacent the second end of the recess can be used. A pulley of this type may be used for tools used in cold or sub-zero environments, or for relatively high compression combustion engines. In all the above cases, a pulley according to the invention contributes to a more uniform pulling force for a user during a cranking operation.

The invention further relates to a spring assisted starter apparatus provided with a rotation limiter. The most common way to start a small internal combustion engine of today is by pulling a starting handle on a recoil starter apparatus. Depending on engine size and performance of the starting apparatus the overall experience for the operator can differ widely. If the operator is inexperienced or physically impaired, it has been shown that the overall pulling technique including pulling speed, pulling length and/or pulling force sometimes is insufficient for starting an engine.

As indicated above, a starting apparatus usually comprises a housing, a pulley, a return spring for the pulley, and a driver or hub configured to drivingly engage an internal combustion engine, a flexible member, such as a cord or rope wound around the pulley, and a handle. An example of this is shown in FIG. 1. In the most simple and compact solution the pulley and the hub are combined into one item, i.e. no buffering element (spring) is arranged between the starter handle and the crankshaft. In such a solution it is almost inevitable not to feel the corresponding compression shocks transferred from the engine into the handle during a starting operation.

A first improved solution is to place an equalizing spring, which may be a torsion spring, between the pulley and the hub, which will dampen most of the compression shocks. Note that it is impossible to start an engine using only the windup energy from an equalizing spring alone. The operator needs to use the same pulling technique as before, although with lower reaction forces in the handle.

A second solution is to use a power accumulating spring, which may be a torsion spring, between the pulley and driver. Unlike the equalizing spring, such spring is designed to be able to be sufficiently energized to overcome the engine compression and start the engine by itself. The working principle of this solution is somewhat different since the spring needs to revolute several revolutions to accumulate sufficient energy before the start attempt can be successful. In this case the pulling technique differs since if pulling too fast the spring will not have enough time to be coiled correctly and is less energized than intended. In other words, a power accumulating spring creates an effortless pull without any reaction force in the handle, but with the drawback of a longer pull cycle and the fact that you cannot perform a conventional "fast" pull. A mechanical feature that combines the smooth effortless behaviour from said second solution, but with the possibility to perform a conventional fast starting pull, would be a desirable feature for an operator.

The starting apparatus according to the invention uses a spring, suitably a torsion spring, between the pulley and the hub to accumulate energy therein. The apparatus further comprises a rotation limiter connecting the rear side of the hub to the pulley. The rotation limiter allows the pulley to rotate a predetermined number of revolutions relative to the hub before it engages and locks the pulley and the hub to each other. When this occurs, the torsion spring has not accumulated a sufficient amount of energy to start the engine by itself. The accumulated energy level is set close to the engine's highest compression (at top dead centre). The operator must at this point continue the pull and rotate the pulley and the hub to finally overcome this compression. At this point the piston passes the top dead centre into a state with a lower compression (downward motion of the piston), whereby the spring will release its accumulated energy and start the engine.

Preferably, the hub is configured to drivingly engage the internal combustion engine upon rotation of the hub in a first direction, A, and the pulley is interconnected with the hub by the spring. Further, the starting device includes a rotatable part having first engagement means, and the pulley includes a second engagement means and the hub includes a third engagement means. The starting device is arranged such that after rotation a first angular distance of the pulley in direction A, starting from a reset position of the starting device, the second engagement means of the pulley engages the first engagement means of the rotatable part so that the rotatable part is brought into rotation together with the pulley. Moreover, after rotation of the pulley a further angular distance in direction A, the first engagement means of the rotatable part engages the third engagement means of the hub so that the hub is brought into rotation in direction A together with the rotatable part and the pulley. This way, a rotation limiter for the spring is provided which allows the spring to be energized to a predetermined level during more than a full revolution of the pulley, and allowing a smooth but fast start pull. The reset position of the starting device is a non-operative position of the starting device when not used for starting the engine, i.e. a position for which a relative rotation angle between the pulley and hub is zero degrees.

Preferably, the rotatable part comprises two discs, the discs configured to be rotatable an angular distance relative to each other, and are located between the pulley and the hub, and the first engagement means comprises a first structure on the first disc, and a second and third structure on the second disc. Further, the starting device is arranged such that after rotation a first angular distance of the pulley in direction A, starting from a reset position of the starting device, the second engagement means of the pulley engages the first structure of the first disc so that the first disc is brought into rotation together with the pulley. Moreover, after rotation of the pulley an additional second angular distance in direction A, the first structure of the first disc engages the second structure of the second disc so that the second disc is brought into rotation in direction A together with the first disc and the pulley.

After rotation of the pulley an additional third angular distance in direction A, the third structure of the second disc engages the third engagement means of the hub so that the hub is brought into rotation in direction A together with the pulley and the first and second discs.

Preferably, the first structure of the first engagement means includes a radially projecting rotation stop on the first disc, and the second structure of the first engagement means includes a first axially projecting stop on the second disc, and the third structure of the first engagement means includes a second axially projecting rotation stop on the second disc. Also preferably, the second engagement means includes an axially projecting driving catch on the pulley, and the third engagement means includes an axially projecting final stop on the hub. It is however appreciated that other ways of configuring the engagement means are conceivable.

Preferably, the engagement means are configured such that the first, second and third angular distances are in the range of 180-360 degrees, and preferably in the range of 240-340 degrees, and more preferably within the range of 270-330 degrees, such as 300 degrees.

Preferably, the maximum relative rotation angle of the pulley relative to the hub is more than 360 degrees, such as more than 720 degrees, for example about 900 degrees. At said maximum relative rotation angle, the spring is configured to have accumulated energy to a level not sufficient to be able to rotate the hub and start the engine by itself. According to a preferred example, the rotatable part of the rotation limiter includes a series of discs, i.e. at least one, but preferably two or even three discs, placed parallel on top of each other, such as axially displaced and adjacent each other, and rotationally limited relative to each other using engagement means, such as structures in the form of end stops. In one example the rotation limiter can engage after 2.5 revolutions, or 900°, of the pulley relative to the hub. The number of revolutions is selected to allow loading of the torsion spring to a desired, predetermined energy level.

The invention will be described in further detail below applied to a chain saw. However, the invention is not limited to this application, but can be used for any type of stationary or portable motorized tool or machine that is driven by a manually started internal combustion engine e.g. lawn mowers, brush cutters, cultivators and leaf/snow blowers.

BRIEF DESCRIPTION OF DRAWINGS

In the following text, the invention will be described in detail with reference to the attached drawings. These schematic drawings are used for illustration only and do not in any way limit the scope of the invention. In the drawings.

EMBODIMENTS OF THE INVENTION

Figure 1:
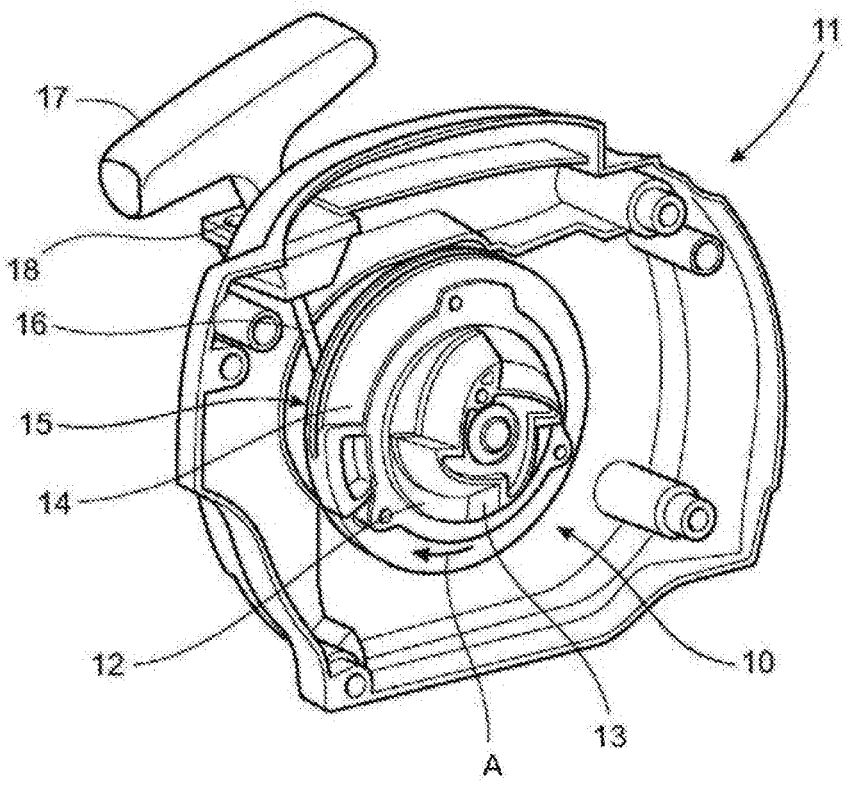
FIG. 1 shows a starting device according to the invention in a cut-away section of a tool housing.

FIG. 1 shows a starting device 10 according to the invention mounted in a cut-away section of a tool housing 11, in this case a housing for a chain saw.

The starting device 10 comprises a hub 12 (or driver) configured to drivingly engage an internal combustion engine (not shown) when the hub 12 is rotated in a first direction A. The hub 12 is provided with a number of contact surfaces 13 (four surfaces in this example) intended to cooperate with corresponding surfaces on a device (not shown) for rotating the combustion engine crankshaft during cranking. When the combustion engine starts, the device will disengage the contact surfaces, or teeth 13 of the hub 12. Such arrangements are well known in the art and will not be described in further detail here.

The hub 12 is interconnected with a pulley 14 by a torsion spring (FIG. 2), which torsion spring can be integrated with the pulley or be mounted in a separate housing adjacent the pulley. This will be described in further detail below. Various springs are of course possible, although in the preferred embodiment a torsion spring in the form of a spiral spring or mainspring or a torsion coil spring is used. The pulley 14 comprises a recess 15 arranged in its outer peripheral surface to receive a flexible member 16, in this case a cord (or pull rope). During cranking of the engine, a user pulls a handle 17 to withdraw the flexible member 16 through an opening 18 (FIG. 3) in the housing 11 in order to rotate the pulley 14. The opening 18 acts as a guiding means during rewinding of the flexible member 16. The guiding means 18 is provided for ensuring that the flexible member is wound correctly onto the pulley 14, 47 after an engine start and is preferably an aperture with an area greater than the cross-section area of the flexible member 16. The guiding means 18 is preferably located closer to the second end 15B than to the first end 15A measured along the axis of rotation X of the pulley 15, and preferably between the second end 15B of the recess and a position half-way between the first and second ends 15A, 15B of the recess, measured along the axis of rotation X of the pulley 15.

Rotation of the pulley 14 will energize the torsion spring and rotate the hub 12 in a first direction A to crank the engine, when the accumulated energy of the energized torsion spring is sufficient. A return spring (not shown) is provided for rotating the pulley in the opposite direction, in order to rewind the flexible member onto the pulley.

Figure 2:
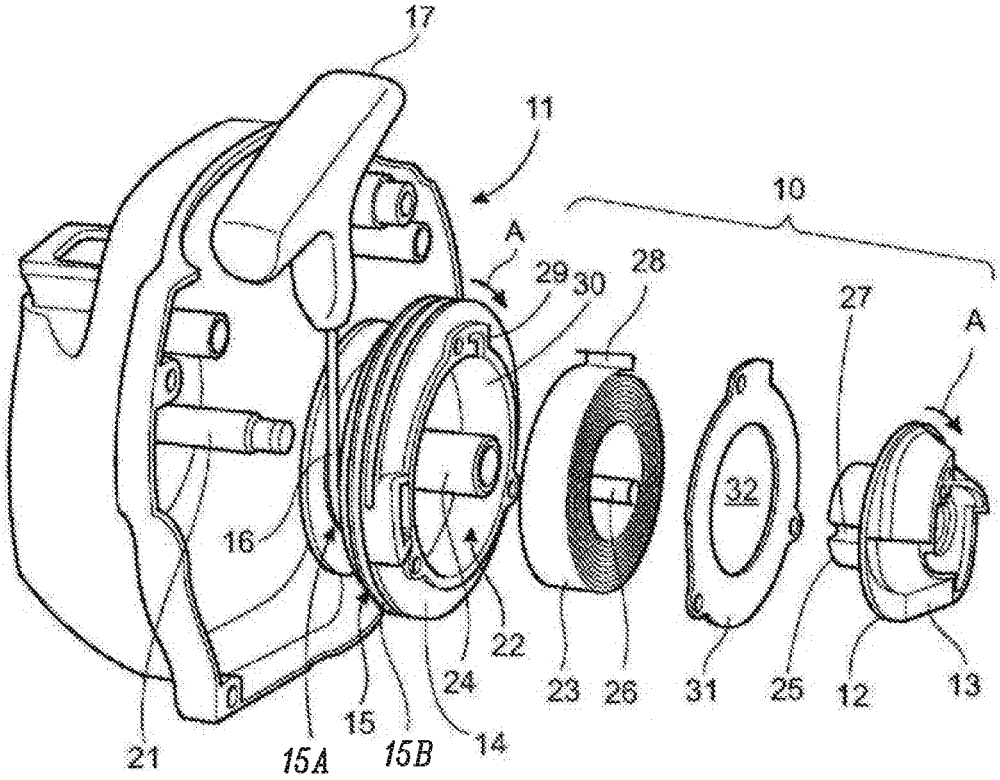
FIG. 2 shows an exploded view of the starting device in FIG. 1.

FIG. 2 shows an exploded view of the starting device as shown in FIG. 1. The starting device 10 in FIG. 2 comprises a shaft 21 mounted in the housing 11. The pulley 14, comprising the recess 15 with the flexible member 16 arranged therein, is rotatably mounted onto the shaft 21. The recess 15 in the pulley 14 has the basic shape of a truncated conical helix having a first end 15A with a first radius $R_1$ (see FIG. 4) and a second end with a second radius $R_2$ (see FIG. 4), larger than the first radius. In this example, the radii are measured between the inner end, or bottom, of the recess 15 and axis X. The flexible member 16 is attached to the pulley 14 at the second end 15B, where the recess 15 in the pulley 14 has its largest radius $R_2$.

According to an alternative example, the last coil 15C (FIG. 4) of the flexible member, which is connected to the handle 17, is wound radially outside a previous coil at the first end of the recess 15A. This arrangement allows the length of the flexible member to be extended without having to increase the width of the pulley. Such an arrangement only has a marginal effect on the initial torque applied by the cord when pulled.

The pulley 14 comprises an annular recess 22 (FIGS. 2 and 3) for receiving therein at least a part of a torsion spring 23, and a central annular portion 24 is located in the annular recess 22 and extending towards the hub 12. This annular portion 24 extends axially outwards from the inner end surface of the annular recess 22 and is rotatably mounted onto the shaft 21. The hub 12 comprises a further annular portion 25 extending towards the pulley 14. The annular portion 25 of the hub 12 extends into the annular recess 22 of the pulley 14, enclosing the annular portion 24 of the pulley 14. In this way the annular portion 25 of the hub 12 is arranged coaxially with and rotatable relative to the annular portion 24 of the pulley 14. The pulley 14 and hub 12 are mounted independently rotatable on the common shaft 21.

The pulley 14 is interconnected with and rotatable relative to the hub 12 by means of the torsion spring 23 which torsion spring is integrated into the pulley 14. At a first, radially inner end 26 the torsion spring 23 is coupled to an axial slot 27 in the annular portion 25 of the hub 12. At a second, radially outer end 28 the torsion spring 23 is coupled to an axial slot 29 in the outer peripheral surface 30 of the annular recess 22 in the pulley 14. In order to prevent the torsion spring 23 from being displaced axially out of the annular recess 22, an annular cover 31 may be mounted over the recess to retain the torsion spring 23. The annular cover 31 has a central opening 32 to allow the hub 12 to be mounted onto the pulley 14. The hub 12 is attached by means of a fastener, such as a nut (not shown) screwed onto a threaded portion at the end of the shaft 21. Alternative means of attaching the hub 12 can include the use of circlips, or providing an internal threaded section in the shaft cooperating with a screw. According to a further alternative, the hub 12 can be arranged to function as a cover 31, which would eliminate the need for a separate cover.

The pulley 14 is rotated in the first direction A when the flexible member 16 is pulled and unwound. As the flexible member 16 is pulled, rotation of the pulley 14 will cause the torsion spring 23 to coil tighter to accumulate energy. The torsion spring 23 is subsequently arranged to act on the hub 12 to rotate it in the first direction A when releasing the stored energy and drivingly engage the internal combustion engine during cranking.

Figure 3:
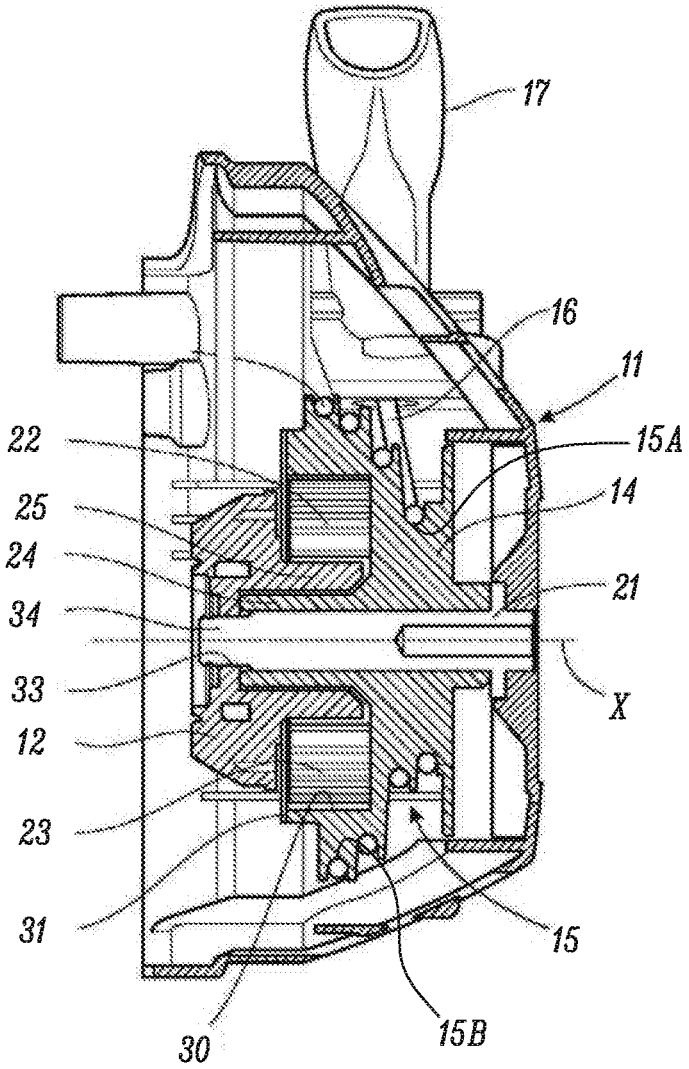
FIG. 3 shows a cross-section of the starting device in FIG. 1.

FIG. 3 shows a schematic cross-section of the starting device in FIG. 1. This figure shows the component parts of the starting device assembled in the housing 11. The shaft 21 is mounted in the housing 11 and supports the pulley 14 with its annular portion 24. The annular portion 25 of the hub 12 is fitted coaxially over the annular portion 24 of the pulley 14. The end of the hub 12 facing away from the pulley 14 is provided with an opening 33 that is fitted onto the free end 34 of the shaft 21. The pulley 14 and hub 12 are mounted independently rotatable about the central axis X of the common shaft 21. The torsion spring 23 is located in the annular space created between the outer peripheral surface 30 of the annular recess 22 in the pulley 14 and the annular portion 25 of the hub 12. The annular cover 31 is mounted over the recess to retain the torsion spring 23 in the annular recess 22 in the pulley 14. A fastener, such as a nut (not shown) is screwed onto a threaded portion at the free end 34 of the shaft 21 to attach the hub 12 and to hold the assembled starting device in place.

Figure 4:
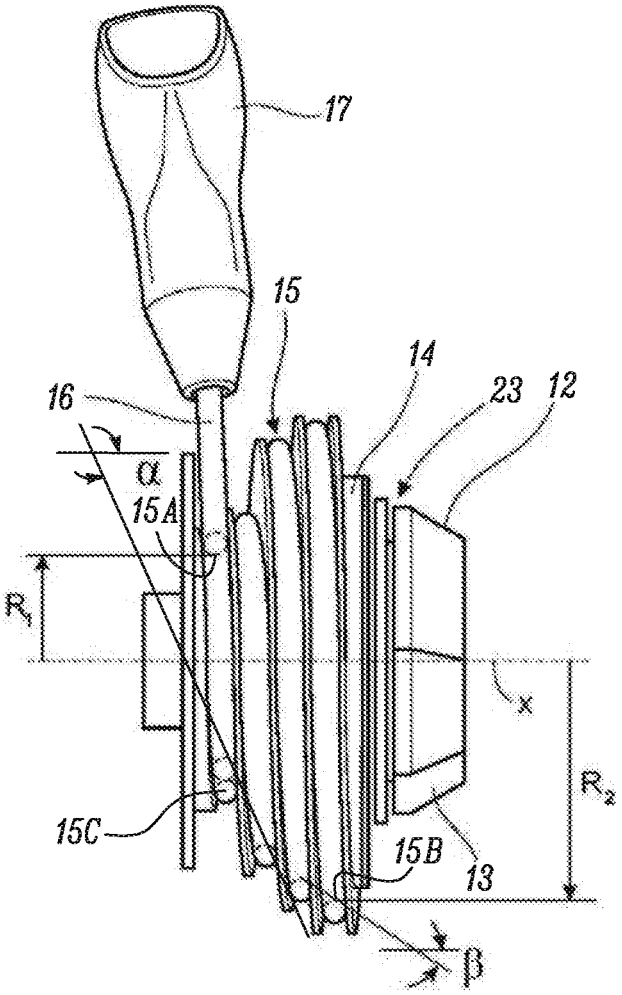
FIG. 4 shows a pulley with a cord wound in a recess.

FIG. 4 shows the pulley 14 with the flexible member 16 wound in the recess 15 between the first and the second end 15A, 15B of the recess 15. According to this example, the conical helix forming the recess 15 has multiple cone angles. A first cone angle α, adjacent the first end 15A is greater than a second cone angle β adjacent the second end 15B. Hence, the conical helix forming the recess 15 has is its largest cone angle adjacent the first end 15A. The hub 12 is mounted to the pulley 14 adjacent the second end 15B of the recess. The recess 15 in the pulley 14 has the basic shape of a conical helix where the first end 15A has a first radius $R_1$ and the second end 15B has a second radius $R_2$, larger than the first radius $R_1$.

As the flexible member 16 is pulled, the radius at which it acts on the pulley 14 will increase from the initial radius $R_1/2$ towards the maximum radius $R_2/2$ at a decreasing rate, while still providing an increasing torque to compensate for the gradually increasing resistance from the torsion spring 23 (see FIGS. 2 and 3) as it is coiled tighter.

The relatively low torque applied to the pulley 14 by the flexible member 16 when located at the smallest radius $R_1$ of the recess 15 will therefore be sufficient for the initial coiling of the torsion spring. As the flexible member 16 is pulled further the radius at which it acts on the pulley 14 will increase, providing an increasing torque to compensate for the gradually increasing resistance from the torsion spring as it is loaded by being coiled tighter.

Figure 5:
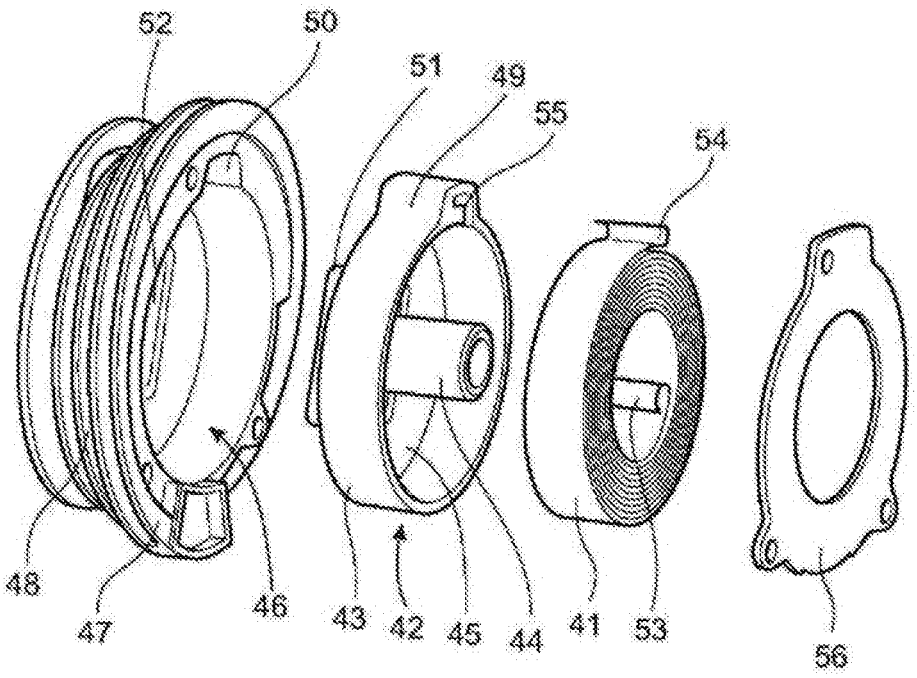
FIG. 5 shows an exploded view of an alternative torsion spring mounting for a starting device according to FIG. 2.

FIG. 5 shows an exploded view of an alternative torsion spring mounting for a starting device according to FIG. 2. According to the example described for FIG. 2 above, the annular portion 25 of the hub 12 extends into the annular recess 22 in the pulley 14 to enclose the annular cavity 30 in the pulley 14. In this way, at least a part of the torsion spring 23 is enclosed by the annular cavity 30 formed by the annular recess in the pulley and the annular portion of the hub.

According to a second alternative example, shown in FIG. 5, the coils of a torsion spring 41 can be located in a separate housing 42 comprising an outer cylindrical wall 43 and a central annular portion 44 connected by a radial end wall 45. This annular portion 44 extends from the inner end surface of the radial end wall 45 along an above-mentioned shaft (FIG. 2; "21") that supports the starting device.

The separate housing 42 forms an annular space or cavity that encloses the torsion spring 41. The separate housing 42 is located in a cylindrical recess 46 in a pulley 47. It is appreciated that the recess 46 does not have to be cylindrical as long as it is adapted to receive separate housing 42. The recess 46 is arranged in an end surface of the pulley 47 adjacent the end of a helical recess 48 (see FIG. 2; "15"). The housing 42 and the pulley 47 comprise a projection 49 and a corresponding recess 50, respectively, for positioning and for preventing relative rotation. The projection 49 extends radially outwards into the recess 50 in the recess 46 in the pulley 47. A complimentary means for preventing relative rotation between the housing 42 and the pulley 47 is an axial projection 51 located at the end of the separate housing 42. The axial projection 51 is arranged to cooperate with a corresponding recess 52 in the cylindrical recess 46 in the pulley 47. The axial projection 51 used in this example has four sides.

The torsion spring 41 is coupled at its first, radially inner end 53 to the hub (see FIG. 2; "12") configured to drivingly engage an internal combustion engine, as described above. Similar to the embodiment shown in FIG. 2, the hub comprises an annular portion (not shown) extending towards the pulley, wherein the first end 53 of the torsion spring 41 is attached to this annular portion. In the same way as shown in FIG. 2, the annular portion 44 of the separate housing 42 extends towards and into the annular portion of the hub.

The second radially outer end 54 of the torsion spring 41 is coupled to the outer cylindrical wall 43 of the separate housing 42. The radial projection 49 extending from the separate housing 42 into the corresponding radial recess 50 in the pulley 47 is provided with a slot 55 adapted to form an attachment for the radially outer end 54 of the torsion spring 41. In order to prevent the torsion spring 41 from being displaced axially out of the housing 42, an annular cover 56 is mounted over the annular cavity to retain the torsion spring 41.

Depending on the desired characteristics of the pulling force and/or the internal combustion engine to be started, the pulley and its recess can be adapted accordingly. Hence, the cone angle can be selected constant, gradually decreasing or gradually increasing. The conical helix forming the recess can have a cone angle that decreases or increases, respectively, at a predetermined rate with each revolution from the first end towards the second end of the recess. Such arrangements will both reduce the size of the pulling force and minimize fluctuations in pulling force when starting the engine.

Figure 6:
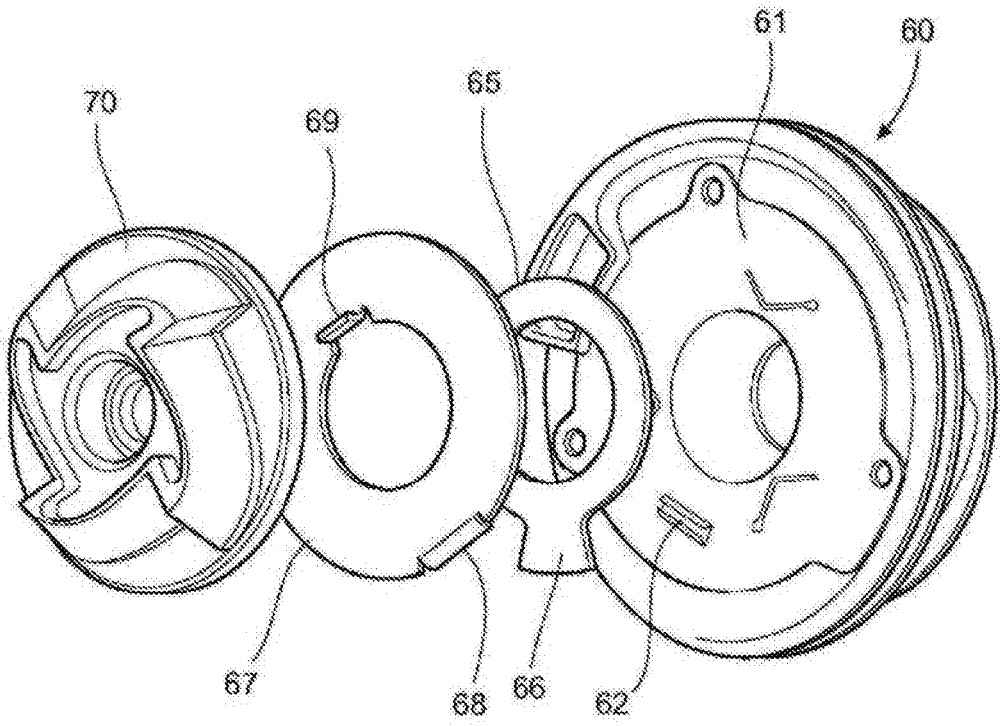
FIG. 6 shows an exploded view of a rotation limiter, that can be applied to a starting device according to the invention.

FIG. 6 shows an exploded view of a rotation limiter that can be applied to starting device according to the invention. FIG. 6 shows a pulley 60 with a cover 61, which pulley can be the same or similar to that shown in FIG. 5. The pulley can also be a pulley with one annular recess at its periphery for receiving the flexible member, the recess not being shaped as a conical helix. The cover 61 is fixed onto and rotatable with the pulley 60. The cover 61 is provided with a driving catch 62 extending a predetermined distance axially away from the pulley 60. Alternatively, this catch could be provided on the end surface of the pulley facing the hub. A first disc 65 is placed in contact with and is rotatable relative to the cover 61 over a predetermined first angle. The first disc 65 has a substantially annular shape and is provided with a radial rotation stop 66 extending radially from its outer periphery. The radial rotation stop 66 is arranged to cooperate with the catch 62. During a starting operation, the catch 62 will contact the radial rotation stop 66 and begin to rotate the first disc 65 when the pulley 60 has been rotated over the first predetermined angle.

A second disc 67 is placed in contact with and is rotatable relative to the first disc 65 over a predetermined second angle. The second disc 67 has a substantially annular shape and is provided with a first axial rotation stop 68 extending axially from its outer periphery and a second axial rotation stop 69 extending axially from its inner periphery. The first axial rotation stop 68 is arranged to cooperate with the radial rotation stop 66. During a starting operation, the radial rotation stop 66 will contact the first axial rotation stop 68 and begin to rotate the second disc 67 when the pulley 60 and the second disc 65 have been rotated together over the second predetermined angle. The first, second and third predetermined angles are between 180 and 360 degrees, and preferably about 300 degrees.

The second disc 67 is placed in contact with and is rotatable relative to a hub 70 over a third predetermined angle. The second axial rotation stop 69 is arranged to cooperate with a circumferential groove ("71" see FIG. 7*d*) extending axially into the rear surface of the hub 70 facing the pulley 60. During a starting operation, the second axial rotation stop 69 will contact a final rotation stop 72 in the groove 71 and begin to rotate the hub 70 when the pulley 60, the first disc 65 and the third disc 67 have been rotated together over the third predetermined angle.

The first and second discs 65, 67 are held in place by an annular portion 73 (see FIGS. 7*b* & 7*c*) of the hub 70 extending towards the pulley 60. The annular portion 73 is used for attaching the hub 70 to the pulley 60. This has been described in detail in connection with FIG. 2. The annular portion is preferably but not necessarily of the same type as shown in FIGS. 2 and 3 (see reference numeral "25").

FIGS. 7*a*-7*d* shows end views of component parts making up a rotation limiter according to FIG. 6. All end views are seen in the direction from the pulley 60 towards the hub 70, wherein the direction of rotation of the components during a starting procedure when the flexible member is pulled is counter clockwise, as indicated by the arrow $A_S$ in FIG. 7*a*.

Figure 7A:
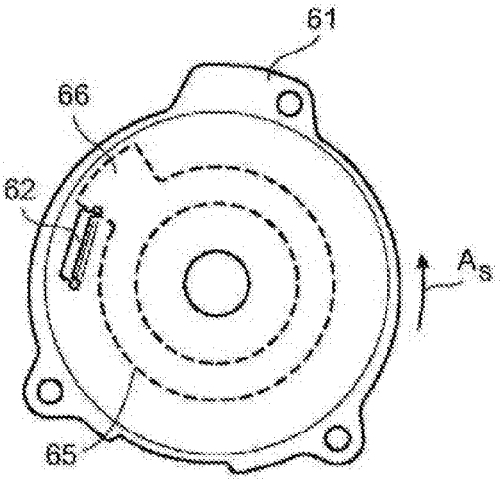
FIGS. 7*a-d* shows end views of component parts making up a rotation limiter according to FIG. 6.

The operation of the rotation limiter will now be described with reference to FIGS. 6 and 7*a*-7*d*. When the operator starts to pull the handle and the flexible member (not shown), the pulley 60 starts to rotate relative the hub 70, which is held in position by the engine compression via the crankshaft. In this particular example, the pulley 60 can rotate freely over a first angle of 300° until the catch 62 reaches the radial rotation stop 66 of the first disc 65. FIG. 7*a* shows the initial relative positions of the pulley 60 and the first disc 65.

Figure 7B:
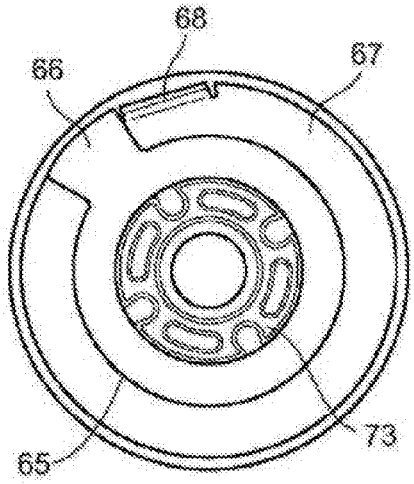

The first disc 65 and the pulley 60 then engage and continue to rotate as a unit. The first disc 65 can rotate freely over a second angle of 300° until the radial rotation stop 66 reaches the first axial rotation stop 68 of the second disc 67. FIG. 7*b* shows the initial relative positions of the first disc 65 and the second disc 67.

Figure 7C:
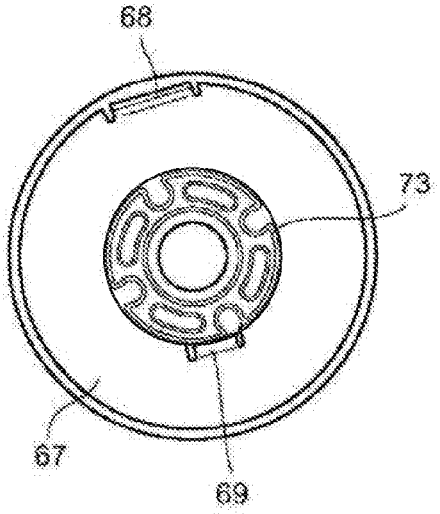
Figure 7D:
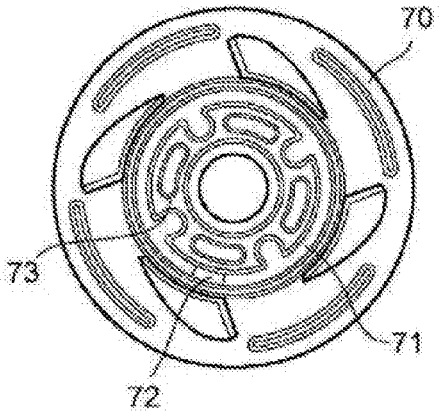

The second disc 67, first disc 65 and the pulley 60 then engage and continue to rotate as a unit, pushed forward by the rotated pulley 60. The second disc 67 can rotate freely over a third angle of 300° until the second axial rotation stop 69 hits the final rotation stop 72 in the groove 71 in the hub 70. FIG. 7*c* shows the initial relative positions of the second disc 67 and the hub 70. FIG. 7*d* shows the initial position of the hub 70 in FIG. 7*c*, indicating the position of the circumferential groove 71 and the final rotation stop 72 in the groove 71.

When the second axial rotation stop 69 hits the final rotation stop 72 in the groove 71, the torsion spring in the pulley 60 is fully loaded. At this point the torsion spring located in the pulley 60 (see FIG. 4 or 5) is preloaded by 2.5 revolutions, or 900°, as it is connected between the pulley 60 and the hub 70. Examples of a suitable connection have been described in connection with FIGS. 2 and 5. The complete unit comprising the hub 70, the second disc 67, first disc 65 and the pulley 60 now starts to rotate and displaces the crank and piston towards the top dead centre of the cylinder.

As the operator continues to pull the handle, the hub will rotate the crankshaft to displace the piston past the top dead centre. The piston then starts to accelerate due to the lower compression and the hub 70 continues to exert torque on the crankshaft, while releasing the accumulated energy in the spring. The hub 70 will be rotated in the same direction of the pulley, as the spring energy build-up is neutralized. The first and second discs 65, 67 are forced to rotate accordingly. The hub 70 rotates 300° in the same direction indicated in FIGS. 7*a*-7*d*, while pushing the second disc 67 in front of it. After another 300° of rotation, the first disc 65 will be rotated towards its initial position. The hub and the two discs 65, 67 are then rotated another 300° until they come to a stop against the pulley 60. The starting device is now "reset" for next pulling operation. According to a further example, it is possible to "preload" the first disc against the pulley by pre-setting an initial load on the torsion spring accordingly.

An advantage of the rotation limiter is that the rotation limiter protects the torsion spring from being over-stressed, as the pulley and the hub will engage before the torsion spring can be overloaded. The rotation limiter also enables the use of an optimized torsion spring, which creates a more compact and slim starting apparatus. In addition, a broader pulling speed interval is allowed, from a pulling speed lower than a conventional given minimum speed to a pulling speed faster than said given minimum speed.

A rotation limiter as described above is applicable to any one of the above examples described in FIGS. 1-5. However, the rotation limiter can also be applied to any power accumulating starting apparatus comprising a pulley, a hub and an intermediate torsion spring where the above advantages are desired.

The invention is not limited to the above embodiments, but may be varied freely within the scope of the claims.

The invention claimed is:

1. A starting device for an internal combustion engine, the starting device comprising:

a hub configured to drivingly engage an internal combustion engine when the hub is rotated in a first direction;

a pulley interconnected with the hub by a spring;

a shaft on which the pulley and hub are mounted independently rotatable;

a flexible member attached to and coiled about the pulley; and the spring coupled at a first end to the hub and at a second end to the pulley, wherein the pulley is rotated in the first direction when the flexible member is pulled and unwound, wherein the spring is arranged to act on the hub during start, wherein the pulley comprises a conical body with a recess arranged to receive the flexible member, wherein the recess substantially has the shape of a conical helix having a first end with a first radius and a second end with a second radius, the second radius being larger than the first radius; and wherein the flexible member is attached to the pulley at the second end.

2. A starting device according to claim 1, wherein the pulley comprises an annular recess for receiving therein at least a part of the spring.

3. A starting device according to claim 2, wherein the second end of the spring is attached to an outer periphery of the annular recess.

4. A starting device according to claim 2, wherein the pulley comprises an annular portion located in the recess and extending towards the hub.

5. A starting device according to claim 2, wherein the hub comprises an annular portion extending towards the pulley, wherein the first end of the spring is attached to the annular portion.

6. A starting device according to claim 5, wherein the annular portion of the hub extends into the annular recess in of the pulley.

7. A starting device according to claim 6, wherein at least the part of the spring is located in an annular space formed by the annular recess of the pulley and the annular portion of the hub.

8. A starting device according to claim 2, wherein at least the part of the spring is located in an annular space formed by a separate housing located in the annular recess of the pulley and the annular portion of the hub.

9. A starting device according to claim 1, wherein the conical helix forming the recess has a constant cone angle.

10. A starting device according to claim 1, wherein the conical helix forming the recess has at least two cone angles.

11. A starting device according to claim 10, wherein the conical helix forming the recess has a first cone angle adjacent the first end and has a second cone angle that decreases with each revolution towards the second end, and wherein the first cone angle, adjacent the first end, is greater than the second cone angle adjacent the second end.

12. A starting device according to claim 10, wherein the conical helix forming the recess has a first cone angle, adjacent the first end, that is less than a second cone angle adjacent the second end, and wherein the second cone angle that increases with each revolution towards the second end.

13. A starting device according to claim 1, wherein at least a part of a last coil of the flexible member is wound radially outward of a previous coil of the flexible member at the first end of the recess.

14. A starting device according to claim 1, wherein an aperture acting as a guiding means is provided for guiding the flexible member onto the pulley after an engine start, wherein the guiding means is closer to the second end of the recess than to the first end of the recess, measured along an axis of rotation of the pulley.

15. A starting device according to claim 1, wherein a rotation limiter is arranged between the pulley and the hub, wherein the pulley is rotated at least one revolution before engaging the hub.

16. A starting device according to claim 15, wherein a number of revolutions is selected to load the spring to a predetermined accumulated energy level.

17. A starting device according to claim 15, wherein, when the pulley is in engagement with the hub, the spring is arranged to release accumulated energy of the spring upon continued rotation of the pulley and the hub.

18. A starting device according to claim 1, wherein the starting device further comprises a rotatable part having first engagement means;

wherein the pulley comprises second engagement means and the hub comprises third engagement means, wherein the starting device is arranged such that after rotation a first angular distance of the pulley in the first direction, starting from a reset position of the starting device, the second engagement means of the pulley engages the first engagement means of the rotatable part so that the rotatable part is brought into rotation together with the pulley, and after rotation of the pulley a further angular distance in the first direction, the first engagement means of the rotatable part engages the third engagement means of the hub so that the hub is brought into rotation in the first direction together with the rotatable part and the pulley.

19. A starting device for an internal combustion engine, comprising:

a hub configured to drivingly engage an internal combustion engine when the hub is rotated in a first direction;

a pulley interconnected with the hub by a spring; and the spring;

wherein the starting device further comprises a rotatable part having first engagement means;

wherein the pulley comprises second engagement means and the hub comprises third engagement means, wherein the starting device is arranged such that after rotation a first angular distance of the pulley in the first direction starting from a reset position of the starting device, the second engagement means of the pulley engages the first engagement means of the rotatable part so that the rotatable part is brought into rotation together with the pulley, and after rotation of the pulley a further angular distance in the first direction, the first engagement means of the rotatable part engages the third engagement means of the hub so that the hub is brought into rotation in the first direction together with the rotatable part and the pulley.

20. A starting device according to claim 19, wherein the rotatable part comprises a first disc and a second disc, the first and second discs being rotatable an angular distance relative to each other, and are located between the pulley and the hub, and the first engagement means comprises a first structure on the first disc, and a second structure and third structure on the second disc, wherein the starting device is arranged such that after rotation the first angular distance of the pulley in the first direction, starting from the reset position of the starting device, the second engagement means of the pulley engages the first structure of the first disc so that the first disc is brought into rotation together with the pulley, and after rotation of the pulley an additional second angular distance in the first direction, the first structure of the first disc engages the second structure of the second disc so that the second disc is brought into rotation in the first direction together with the first disc and the pulley, and after rotation of the pulley an additional third angular distance in the first direction, the third structure of the second disc engages the third engagement means of the hub so that the hub is brought into rotation in the first direction together with the pulley and the first and second discs.

21. A starting device according to claim 20, wherein the engagement means are configured such that the first, second and third angular distances are in a range of 180-360 degrees.

22. A starting device according to claim 19, wherein upon rotation of the pulley in the first direction and engagement of the first and third engagement means at a maximum relative rotation angle between the hub and the pulley, the spring is configured to have accumulated energy to a level not sufficient to be able to rotate the hub and start the engine by itself.

23. A starting device according to claim 19, wherein the rotatable part includes a first disc and a second disc and the first engagement means includes a radially projecting rotation stop on the first disc, and a first axially projecting stop on the second disc, and a second axially projecting rotation stop on the second disc and wherein the second engagement means includes an axially projecting driving catch on the pulley, and the third engagement means includes an axially projecting final stop on the hub.

* * * * *